United States Patent [19]

Cook

[11] 4,061,099

[45] Dec. 6, 1977

[54] OUTRIGGER SAILBOAT

[76] Inventor: Gregory Edward Cook, 3101 South Wabash, Chicago, Ill. 60616

[21] Appl. No.: 771,188

[22] Filed: Feb. 23, 1977

[51] Int. Cl.[2] ..... B63H 9/00

[52] U.S. Cl. ..... 114/39; 114/61; 114/102; 114/111

[58] Field of Search ..... 9/2 R, 2 C, 2 F; 114/39, 61, 102, 103, 111

[56] References Cited

U.S. PATENT DOCUMENTS

| | | | |
|---|---|---|---|
| 1,813,937 | 7/1931 | Krussand | 114/39 |
| 3,173,395 | 3/1965 | Laurent | 114/102 |
| 3,336,890 | 8/1967 | Laurent | 114/39 |
| 3,777,690 | 12/1973 | Garber | 114/39 |

*Primary Examiner*—George E. A. Halvosa
*Assistant Examiner*—D. W. Keen
*Attorney, Agent, or Firm*—Anthony S. Zummer

[57] ABSTRACT

An outrigger sailboat having a drive outrigger hull is disclosed herein. A pair of movable keels is rotatably connected to a bottom portion of the drive outrigger hull. The movable keels are adapted to rotate in opposite directions. A pair of masts is mounted on the outrigger hull. Each of the masts receives a sail. The drive outrigger hull is connected to a load hull by a connector frame. The outrigger sailboat is preferably sailed with the load hull to windward and the drive outrigger hull to leeward. The load hull holds the drive outrigger hull upright even in strong winds. The movable keels act as both keels and rudders to provide directional control.

1 Claim, 6 Drawing Figures

FIG. 4
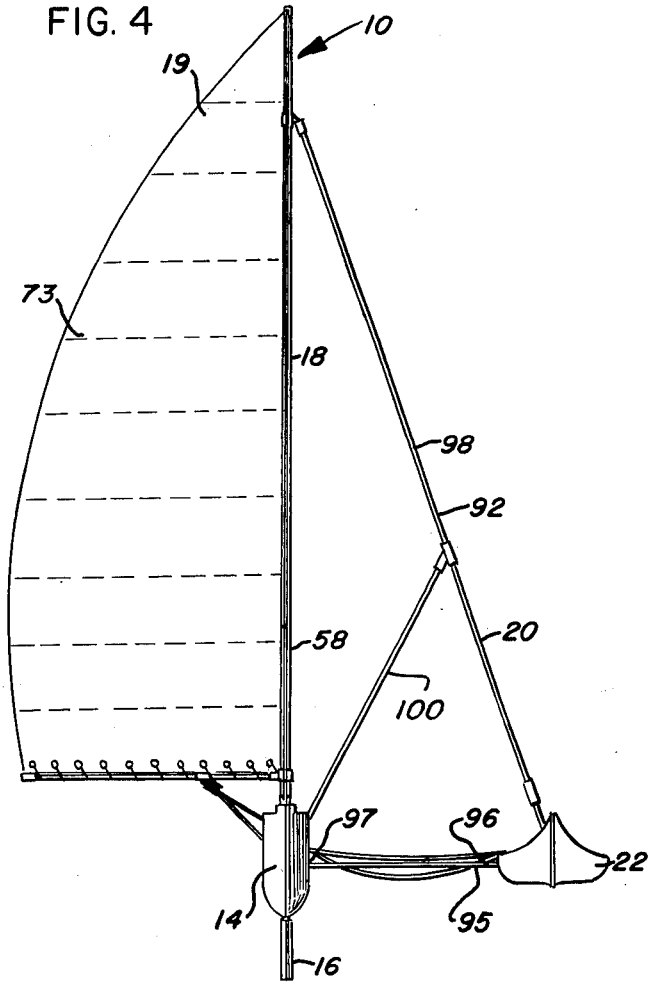
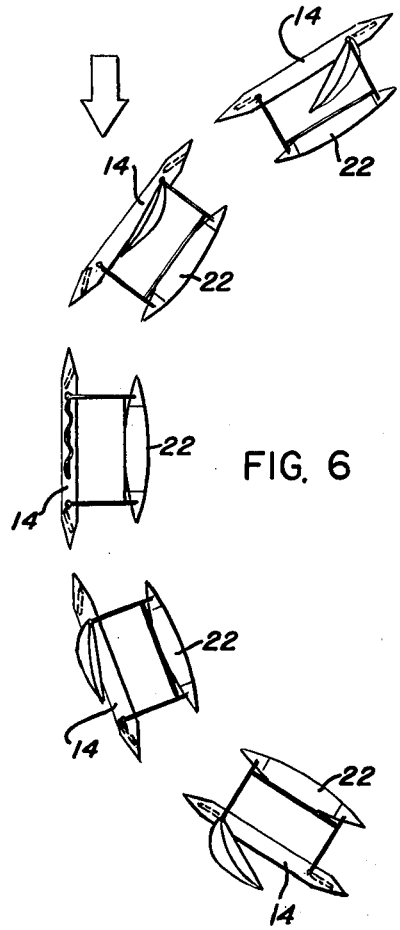
FIG. 6
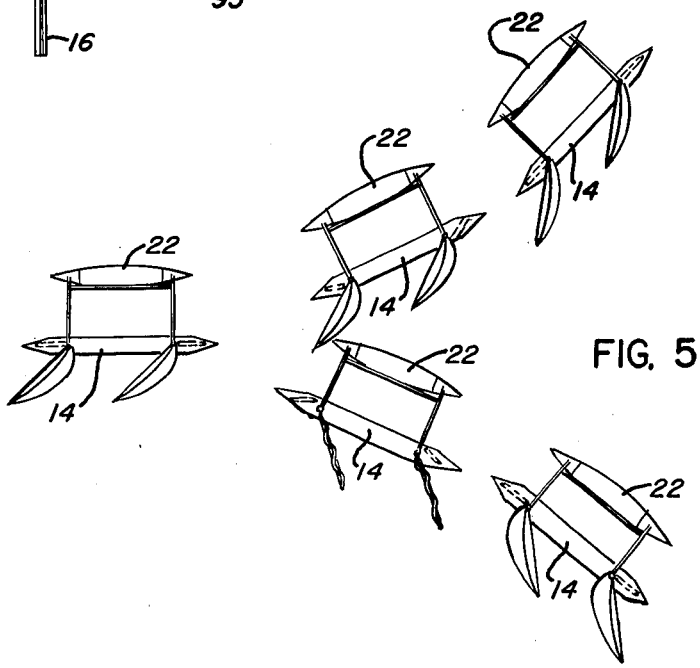
FIG. 5

OUTRIGGER SAILBOAT

BACKGROUND OF THE INVENTION

Sailboats have been used since ancient times to transport cargo and passengers. The earliest sailboats were able to sail downwind, only. As sailboat construction was improved, single hull sailboats were developed which had the ability to sail into the wind, often as much as within 30° of the wind direction. Today's sailors attempt to obtain the maximum possible velocity from a particular sailing construction which can be sailed into the wind.

One of the major inefficiencies which conventional sailboats presently have, particularly single hull sailboats, is that the conventional sailboat rolls or heels when it is being sailed into the wind. This roll or heel, particularly in small boats, must be counterbalanced, often by shifting ballast or the crew itself within the boat, to maintain the sailboat upright.

The sailboat should be maintained in as upright a position as possible for two reasons. First, if the sailboat tips too far in a strong wind, the sailboat can heel over and capsize, thereby, at the very least, throwing the sailors into the water and possibly causing injury or drownings. Secondly, the sails should be maintained in as upright a position as possible in order to obtain maximum efficiency from wind moving horizontally across a water surface. As the sailboat heels over, a lesser vertical area of sail is exposed to the horizontal airstream, thereby causing the sailboat to receive less wind thrust.

A number of sailboat designs have been developed over the years in order to solve the above-mentioned problems. Catamarans have often been used which have fairly good roll stability until a critically high wind velocity is reached and the catamaran is flipped over onto its top. Trimarans also suffer from the same problem. The catamaran and the trimaran, in addition are very difficult to maneuver when tacking or turning. The two or three hulls which catamarans or trimarans employ make directional changes very difficult.

The Polynesians have developed a sailing craft known as the proa. The Polynesian proa employs a sailing canoe having a stabilizing outrigger attached thereto. The passengers ride beneath the sails and the sailing ship is maintained in balance in strong winds by passengers or pilots crawling out onto the outrigger in order to shift the center of mass of the sailing vessel toward the outrigger. The proa, however, is often difficult to maneuver; it can overturn once the outrigger is lifted free of the water; and it requires that a passenger or a pilot having some acrobatic ability crawl out along outrigger booms toward the outrigger when the proa is moving quite rapidly.

The prior art discloses the proa concept in a modified form; most notatable is U.S. Pat. No. 3,336,890 to Laurent, which discloses a pair of sails mounted on a keel structure to which an outrigger is connected. A rotatable passenger seat rides on a track which swings over the outrigger. The seat is pivotally connected to the main hull. This keel structure also requires a certain amount of passenger acrobatics to maneuver the vessel in high wind.

What is needed then, is a sailing vessel similar to the Polynesian proa but without its disadvantages. The sailing vessel should be stable in high winds and should not require a great deal of movement on the part of the passengers while the ship is being sailed in changing wind conditions. The sailboat should also be resistant to capsize; able to sail in either direction along its longitudinal axis; and have high stability and safety in high winds while able to travel at high speeds.

SUMMARY OF THE INVENTION

An outrigger sailboat is disclosed herein having a drive outrigger hull. The drive outrigger hull is a narrow elongated symmetric hull having a pair of masts connected thereto. Each of the masts carries a sail on a rotatable boom. A pair of movable keels is connected to a bottom portion of the hull of the outrigger. The keels are rotatable in opposite directions to provide directional stability and turning force for the outrigger hull.

A frame connector is connected to the drive outrigger hull. A load hull is connected to the frame connector. The load hull is a longitudinally and transversely symmetric load hull, pointed at each end, and having a pair of attachment blocks connected thereto.

In operation, the outrigger sailboat is preferably sailed with the load hull to windward. As the outrigger sailboat receives stronger and stronger side winds, which tend to lift the load hull out of the water, the load hull remains in the water. The drive outrigger is forced lower and lower into the water, thus providing an extremely stable, high speed sailing vessel. In addition, the outrigger sailboat may be sailed in either direction since both the drive outrigger hull and the load hull are longitudinally and transversely symmetric.

It is a principal object of the present invention to provide a stable high speed outrigger sailboat.

It is another object of the instant invention to provide an outrigger sailboat which can be sailed in either of two directions.

It is still another object of the present invention to provide an outrigger sailboat having all drive and steering elements mounted on a drive outrigger which is drivingly connected to a passenger hull.

Other objects and uses of the instant invention will become obvious to one skilled in the art upon a perusal of the following specification and claims in light of the accompanying drawings.

BRIEF DESCRIPTION OF THE DRAWINGS

FIG. 4 is a front view of the outrigger sailboat of FIG. 1;

FIG. 5 is a schematic view of a track over which a typical outrigger sailboat embodying the present invention is sailed, together with a plurality of schematic views of the inventive outrigger sailboat positioned at points along the track; and FIG. 6 is a schematic view of an alternative track over which the inventive outrigger sailboat can be sailed, together with a plurality of schematic views of the inventive outrigger sailboat positioned at points along the alternative track.

DESCRIPTION OF THE PREFERRED EMBODIMENT

Figure 1:
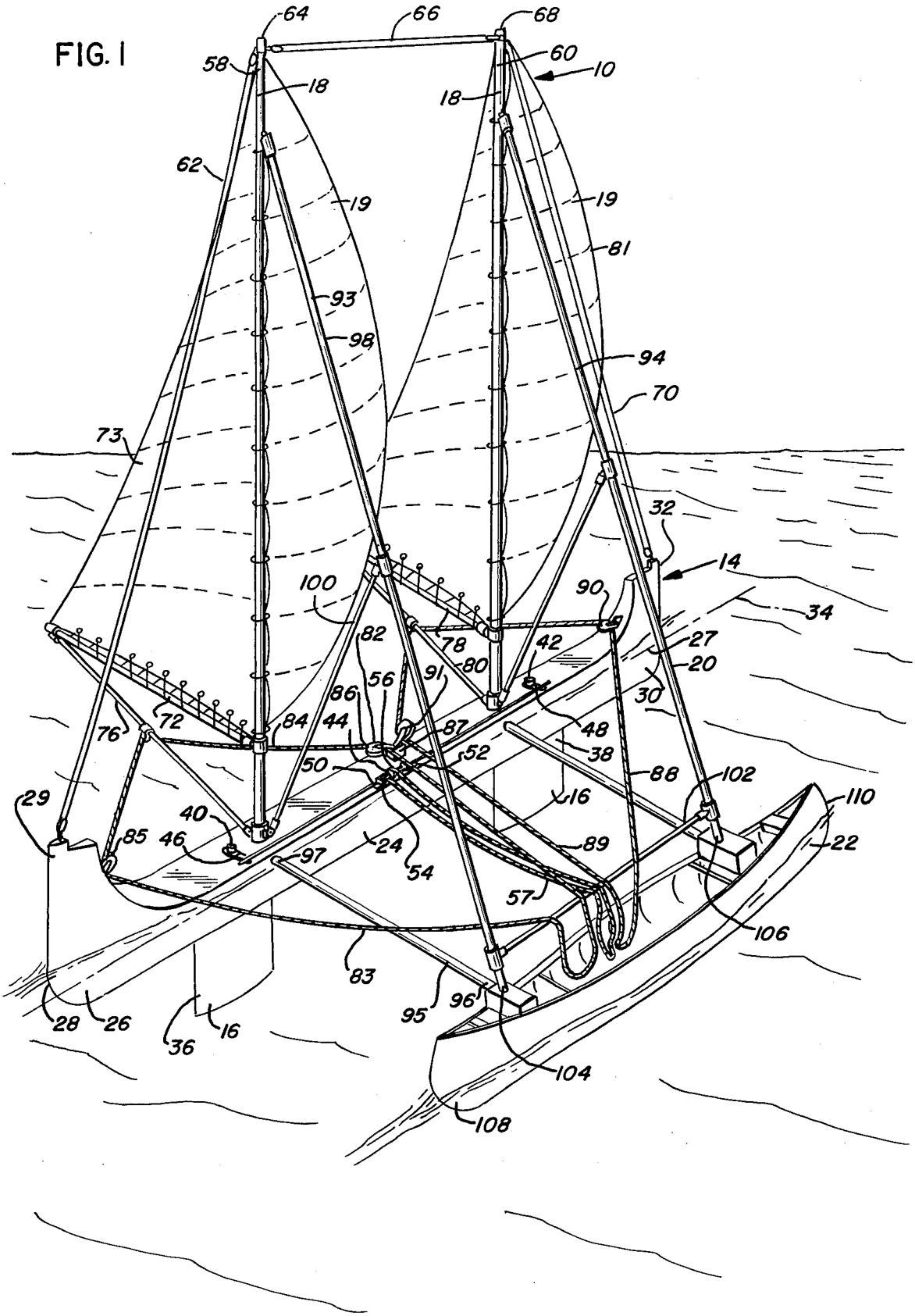
FIG. 1 is a perspective view of an outrigger sailboat embodying the present invention showing details of the connection of a drive outrigger hull to a load hull.
Figure 2:
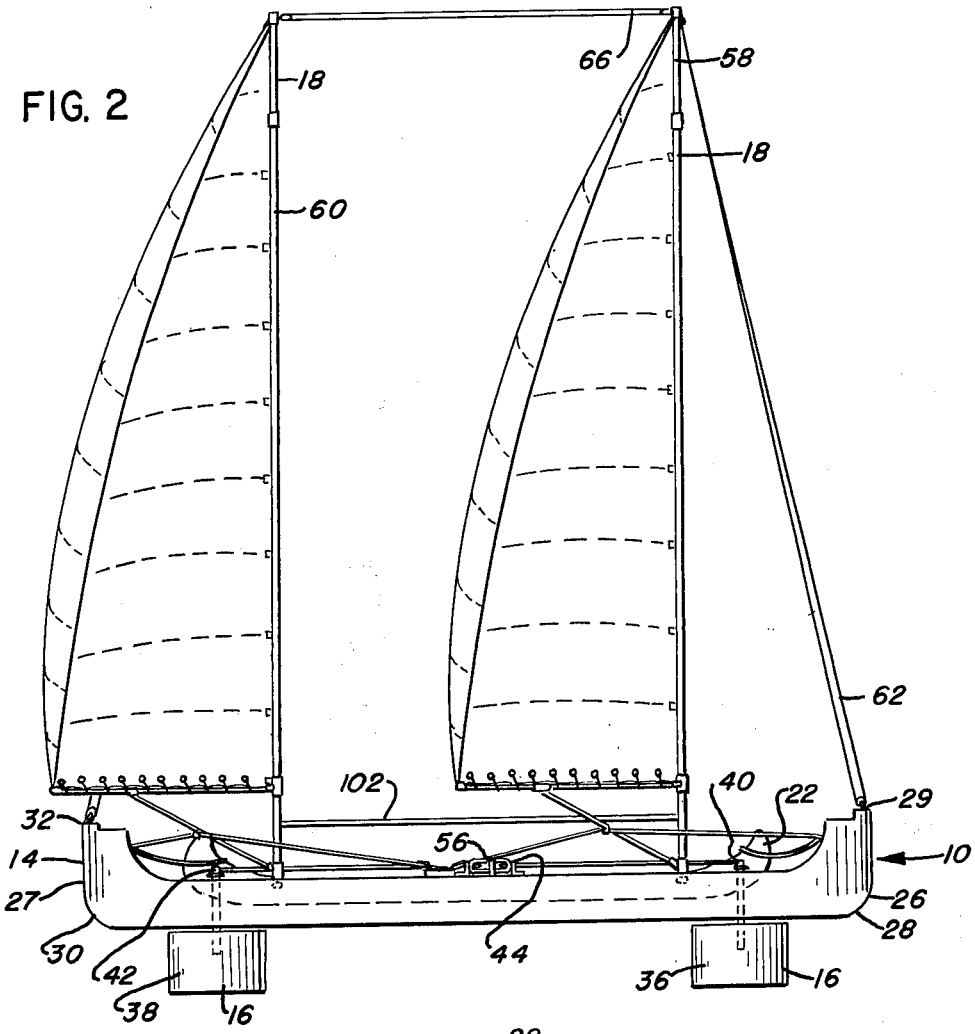
FIG. 2 is a side view of the outrigger sailboat of FIG. 1.
Figure 3:
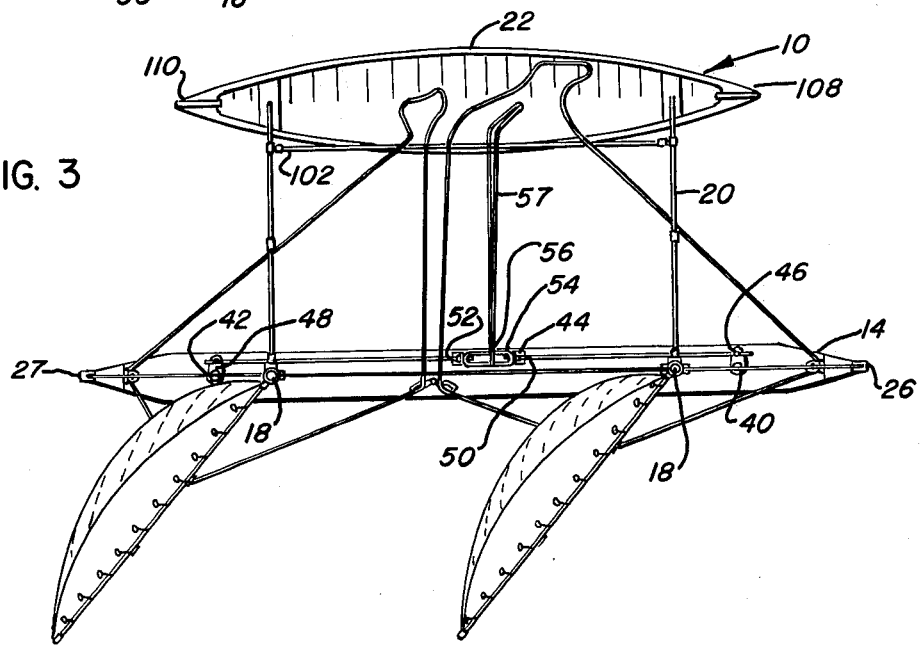
FIG. 3 is a top view of the outrigger sailboat of FIG. 1.

Referring now to the drawings, and especially to FIG. 1, an outrigger sailboat 10 embodying the instant invention is shown therein. Outrigger sailboat 10 includes an outrigger hull 14. A pair of identical rotatable keels 16 and a pair of identical masts 18 are attached to outrigger hull 14. A pair of identical sails 19 is attached to pair of masts 18. A side frame connector 20 is connected to outrigger hull 14. A load hull 22 is connected to outrigger hull 14 by the side frame connector 20.

Drive outrigger hull 14 is an elongated hull having a width, in the present embodiment, of 16 inches and a length, in the present embodiment of 32 feet. Hull 14 is a roughly canoe shaped hull, composed of a buoyant plastic material. Hull 14 has a rectangular cross-section center section 24 to which is formed integral a first end 26 and a second end 27. First end 26 is a tapering, upwardly curving end having a bow curve 28 which sweeps through a 90° angle. Bow curve 28 terminates in a bow tip 29. End 27 is identical to end 26. End 27 has a 90° bow curve 30. End 27 terminates in a bow tip 32. A longitudinal axis 34 is positioned within and parallel to outrigger hull 14.

Pair of movable keels 16 includes a first movable keel 36 rotatably connected to hull 14 and a second movable keel 38 also rotatably connected to 14. Movable keel 36 has a shaft 40 which is rotatably mounted within hull 14 and is positioned proximate to end 26 of hull 14. Movable keel 38 is identical to movable keel 36 and has a shaft 42 which is rotatably mounted within hull 14 proximate to end 27.

Keels 36 and 38 are connected together by a steering control mechanism 44. Steering control mechanism 44 has a first arm 46 connected to shaft 40 and a second arm 48 connected to shaft 42. Arm 46 is connected to a longitudinal threaded connector 50. Arm 48 is connected to a longitudinal threaded connector 52. Longitudinal threaded connectors 50 and 52 are conventionally threadedly connected to a conventional turnbuckle 54. Turnbuckle 54 is connected to a steering wheel 56. A steering loop 57 extends to load hull 22.

Pair of masts 18 includes a first mast 58 and a second mast 60. First mast 58 is positioned perpendicular to outrigger hull 14, immediately adjacent shaft 40 above keel 36. Second mast 60, which is identical to first mast 58, is positioned perpendicular to outrigger hull 14, immediately adjacent shaft 42 above keel 38.

A stay 62 connects a top 64 of mast 58 to tip 29 of end 26 of outrigger hull 14. A stay 66 connects top 64 of mast 58 to a top 68 of mast 60. A stay 70 connects top 68 of mast 60 to tip 32 of end 27 of outrigger hull 14.

A rotatable boom 72 is rotatably connected to mast 58. Boom 72 has a sail 73, one of pair of sails 19, connected to it. A boom brace 76 is connected to boom 72 and is also rotatably connected to mast 58. Boom 72 and boom brace 76 are rotatably connected to mast 58. A rotatable boom 78 is rotatably connected to mast 60. Rotatable boom 78 is identical to rotatable boom 72. A boom brace is rotatably connected to mast 60 and is connected to boom 78. Rotatable boom 78 has a sail 81, one of pair of sails 19, connected thereto.

A boom steering system 82 is connected to booms 72 and 78. Boom steering system 82 includes a first line 83 which is connected to boom 72 and a second line 84 which is also connected to boom 72. Line 83 is connected to a pulley 85 which is mounted on tip 29 of end 26. Line 84 is connected to a pulley 86 mounted on a central pulley block 87. Lines 83 and 84 are joined together to form a self-storing closed loop. A line 88 and a line 89 are connected to boom 80. Lines 88 and 89 are connected together to form a self-storing closed loop line. Line 88 is connected to a pulley 90 mounted on tip 32 of end 27. Line 89 is connected to a pulley 91 mounted on central pulley block 87. Lines 83, 84, 88 and 89 extend into load hull 22.

Connecting frame 20 connects load hull 22 to drive outrigger 14. Connecting frame 20 includes a pair of identical angular frame members 93 and 94. Angular frame members 93 and 94 are parallel angular frame members and each is positioned perpendicular to longitudinal axis 34. Frame member 93 can be taken as an exemplary frame member. Frame member 93 includes an outrigger beam 95 having a pair of ends, respectively numbered 96 and 97. Outrigger beam 95 is connected to outrigger hull 14 at end 97 adjacent a point at which mast 58 enters hull 14. A hypotenuse brace 98 is connected between top 64 of mast 58 and end 96 of outrigger beam 95. Mast 58, hypotenuse brace 98 and outrigger beam 95 define a right triangle in which mast 58 defines a base, outrigger beam 95 defines an adjacent side and hypotenuse brace 98 defines a hypotenuse of a right triangle. A brace 100 is connected from a midpoint of hypotenuse brace 98 to a point immediately adjacent the point where mast 58 is connected to outrigger hull 14. A longitudinal brace 102 connects frame members 93 and 94 together and holds them in a parallel position which is perpendicular to longitudinal axis 34. Angles 93 and 94 each have a connection apex, respectively numbered 104 and 106 at load hull connector 92.

Load hull 22 is connected to frame connector 20 at connection apices 104 and 106. Load hull 22 is an elongated load hull capable of carrying passengers or cargo. Load hull 22 has a longitudinally and transversely symmetric shape which is quite similar to the shape of a canoe. Load hull 22 has a first bow 108 positioned immediately adjacent apex 104. Load hull 22 has a second bow 110 positioned immediately adjacent apex 106. Load hull 22 is positioned parallel to longitudinal axis 34.

In operation, outrigger sailboat 10 is placed in water, and for conventional use, load hull 22 has a mass slightly greater than the buoyancy of outrigger hull 14. After being placed in the water, outrigger sailboat 10 is aligned with the wind as may be seen best in FIG. 5 with load hull 22 to windward and outrigger hull 14 to leeward. Booms 72 and 80 are directed by boom steering system 82 at an angle to leeward and sails 73 and 81 catch the wind and drive outrigger hull 14 and load hull 22 through the water. Direction of the sailboat is controlled by rotating turnbuckle 54 to position keels 36 and 38.

As the wind speed increases, a torque is placed on outrigger hull 14 tending to rotate load hull 22 away from the wind, or downwind. However, since load hull 22 is carrying passengers and has a loaded mass somewhat larger than the buoyancy of outrigger 14, outrigger 14, due to the resulting torque, is pushed down into the water, rather than load hull 22 being lifted free of the water. Capsizing is thereby prevented.

In addition, the relatively high tips 29 and 32 of ends 26 and 27 of outrigger hull 14 prevent outrigger hull 14 from being completely swamped, as outrigger hull 14 is forced down into the water from the wind torque placed upon the sails. Thus, bows 26 or 27 do not catch in the water and outrigger sailboat is resistant to capsize longitudinally. Thus, for maximum safety with relatively high speed, the loaded mass of the load hull 22 should be somewhat higher than the maximum buoyancy of outrigger hull 14.

For higher speeds, such as in racing, outrigger hull 14 has a buoyancy slightly greater than the loaded mass of load hull 22. Thus, load hull 22 is lifted clear of the water and skims over the water supported by outrigger hull 14. It is apparent that because outrigger hull 14 has a length more than 20 times its width, the usual hull speed computation factors used for sailboats do not apply. The outrigger hull can travel through the water at a speed approaching the speed of the wind. Thus, by simply selecting the ratio of a relative buoyancy of the outrigger hull 14 to the loaded mass of the load hull 22, performance and safety characteristics can be balanced for a particular craft.

Outrigger sailboat 10 also presents several other advantages. As shown in FIGS. 5 and 6, outrigger sailboat 10 can be sailed as a proa in either direction along longitudinal axis 34, making for ease of tacking and efficiency of use of the outrigger sailboat construction. If one prefers, outrigger sailboat 10 may be sailed as a conventional sailboat with conventional tacking and a consequent slight loss in efficiency when the booms have to be swung around toward load hull 22. There is also a reversal of running operation, since load hull 22 can then be forced down into the water by the wind as outrigger hull 14 is being lifted out of the water.

Longitudinal brace 102 can be removed from frame connector 20 and angular frame members 93 and 94 can be rotated together so that connection apices 102 and 104 form a single connection apex. The single connection apex can then be connected to load hull 22 at a midpoint. The single connection apex allows a variety of load hull lengths to be easily employed.

Thus, outrigger sailboat 10 presents a novel construction in sailboats; having all drive components positioned on a drive outrigger which tows a load hull. This construction counteracts the wind couple tending to rotate the sails away from the wind. The paired keels allow for rapid turning, since they may be rotated in opposite directions and may be fixed in various positions to prevent skidding in the water due to the wind. The relative mass of the loaded load hull to the buoyancy of the drive outrigger may be altered to provide either a safe high speed sailing vehicle or a highly efficient racing vehicle.

Although a specific embodiment of the herein disclosed invention has been described in detail, it is readily apparent that those skilled in the art may make various modifications and changes in the present invention without departing from the spirit and scope of the present invention. Therefore, the present invention is limited only by the appended claims.

What is claimed is:

1. An outrigger sailboat comprising: an elongated drive outrigger hull having a length at least 20 times a width of said elongated drive outrigger hull, said elongated drive outrigger hull having a pair of identical wave cutting bows, said identical wave cutting bows being positioned at opposite ends of said elongated drive outrigger hull; a pair of rotatable keels rotatably connected to said elongated drive outrigger hull, said rotatable keels being rotatable in opposite directions to provide directional control to said elongated drive outrigger hull; a pair of masts mounted on said elongated drive outrigger hull, each of said masts having a rotatable boom rotatably connected thereto, each of said masts and said rotatable booms having a sail attached thereto; a closed loop boom steering device connected to each of said rotatable booms, said closed loop boom steering devices controlling angular position of said rotatable booms with respect to said elongated drive outrigger hull; a pair of angular frame connectors connected to each of said masts, each of said angular frame connectors terminating in an apex; and a symmetric load hull having a pair of identical bows at opposite ends, each of said apices being attached to said symmetric load hull, said symmetric load hull holding said elongated drive outrigger upright in the presence of a wind pressure on said sails and thereby causing said wind pressure on said sails to drive said elongated drive outrigger and said symmetric load hull through water.

* * * * *

UNITED STATES PATENT OFFICE

CERTIFICATE OF CORRECTION

PATENT NO. : 4,061,099

DATED : December 6, 1977

INVENTOR(S) : Gregory E. Cook

It is certified that error appears in the above-identified patent and that said Letters Patent are hereby corrected as shown below:

Column 3, Line 23, after "to", insert --hull--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*